US006389821B2

(12) United States Patent
Strobel et al.

(10) Patent No.: US 6,389,821 B2
(45) Date of Patent: May 21, 2002

(54) CIRCULATING CRYOSTAT

(75) Inventors: Marco Strobel, Karlsruhe; Michael Westphal, Offenbach, both of (DE)

(73) Assignee: Bruker Analytik GmbH, Rheinstetten (DE)

( * ) Notice: Subject to any disclaimer, the term of this patent is extended or adjusted under 35 U.S.C. 154(b) by 0 days.

(21) Appl. No.: 09/892,650

(22) Filed: Jun. 28, 2001

(30) Foreign Application Priority Data

Jul. 8, 2000 (DE) ..... 100 33 410

(51) Int. Cl.[7] ..... F17C 5/02
(52) U.S. Cl. ..... 62/47.1; 62/51.1
(58) Field of Search ..... 62/47.1, 51.1

(56) References Cited

U.S. PATENT DOCUMENTS

| | | | | |
|---|---|---|---|---|
| 3,108,447 A | * | 10/1963 | Maher et al. | 62/47.1 |
| 3,538,714 A | * | 11/1970 | Kling et al. | 62/47.1 |
| 3,984,222 A | * | 10/1976 | DeHaan | 62/47.1 |
| 4,790,147 A | * | 12/1988 | Kuriyama et al. | 62/47.1 |
| 5,586,437 A | * | 12/1996 | Blecher et al. | 62/47.1 |
| 5,646,532 A | | 7/1997 | Knüttel | |
| 5,739,689 A | | 4/1998 | Roth | |
| 5,744,959 A | | 4/1998 | Jeker | |
| 5,782,095 A | * | 7/1998 | Chen | 62/47.1 |
| 6,029,458 A | * | 2/2000 | Eckels | 62/51.1 |

FOREIGN PATENT DOCUMENTS

| | | |
|---|---|---|
| DE | 196 12 539 | 10/1997 |
| EP | 0 773 450 | 5/1997 |
| JP | 50 60 295 | 9/1993 |

OTHER PUBLICATIONS

C. Wang, G. Thummes, C. Heiden, Cryogenics 37, 159 (1997).
C. Wang, G. Thummes, C. Heiden, Cryogenics 37, 337 (1998).

* cited by examiner

*Primary Examiner*—Ronald Capossela
(74) *Attorney, Agent, or Firm*—Paul Vincent

(57) ABSTRACT

A cryostat arrangement for keeping liquid helium comprising an outer shell (2), a helium container (6) installed therein and a neck pipe (4) extending from the helium container to the outer shell whose upper warm end is connected to the outer shell and whose lower cold end is connected to the helium container, wherein the outer shell, the helium container and the neck pipe define an evacuated space (13) containing a radiation shield (15) surrounding the helium container and being connected at a coupling to the neck pipe in a heat-conducting fashion, wherein a refrigerator is installed in the neck pipe having a cold finger **(5*a*) which consists of at least one pipe and projects into the neck pipe, is characterized in that at least one pipe of the cold finger is surrounded by at least one separating body (3*a*) which divides the neck pipe into two partial volumes (8*a* and 9*a*) which are connected to one another through a lower opening (10*a*) and an upper opening (7*a*)**. A cryostat arrangement of this type with active cooling through refrigerators shows considerable improvements over conventional cryostats with respect to thermal properties. In particular, it is possible to completely stop consumption of liquid helium.

13 Claims, 6 Drawing Sheets

CIRCULATING CRYOSTAT

This application claims Paris Convention priority of DE 100 33 410.5 the entire disclosure of which is hereby incorporated by reference.

BACKGROUND OF THE INVENTION

The invention concerns a cryostat arrangement for storing liquid helium, which consists of an outer shell, a helium container installed therein, and a neck pipe extending perpendicularly or at an inclined angle from the helium container to the outer shell whose upper warm end is connected to the outer shell and whose lower cold end is connected to the helium container, wherein the outer shell, the helium container and the neck pipe define an evacuated space containing a radiation shield surrounding the helium container and being connected at a coupling to the neck pipe in a heat-conducting fashion, wherein a refrigerator having a cold finger comprising at least one pipe and projecting into the existing neck pipe is installed into the neck pipe.

Conventional cryostat arrangements of this type (see e.g. U.S. Pat. No. 5,646,532) accommodate superconducting magnets used e.g. as main field magnets in magnetic resonance apparatus.

Superconducting magnets consist of windings of superconducting wire which are cooled down with liquid helium to temperatures of approximately 4.2 Kelvin. The main function of the cryostat arrangement is to keep the superconducting magnet at the predetermined operating temperature by means of liquid helium while thereby consuming as little liquid helium as possible.

The most important structural elements of cryostat arrangements are a helium container accommodating the superconducting magnet and liquid helium, one or more radiation shield(s) surrounding the helium container, an outer vacuum container (referred to below as the outer shell) and one or more neck pipe(s) connecting the helium container to the outer shell.

The helium container is surrounded by a vacuum space which is defined by the helium container itself, the neck pipes and the outer shell. The vacuum space reduces heat input into the helium container through convection as well as heat conduction through residual gas. Radiation shields are located between the helium container and the outer shell to reduce heat input via radiation. To charge the magnet with current, fill it with helium, and to permit evaporation of helium, one or more neck pipes are required which connect the helium container to the outer shell. The free cross-section of the neck pipes must be designed such that even the large amounts of helium gas, occurring e.g. during a so-called quench of the superconducting magnet, can flow off. In such a quench, the superconducting magnet spontaneously heats up to temperatures far above the boiling temperature of helium which causes conversion of liquid helium into helium gas which must flow through the neck pipe into the external space without causing an inadmissibly high pressure increase in the helium container. Such neck pipes can e.g. be made from stainless steel, titanium alloys or GFK. To keep the height of a cryostat low, the neck pipes disposed in the upper region of the cryostat usually have a length of approximately 1 m or less. They represent a heat bridge between the outer shell and the helium container. Neck pipes normally extend perpendicularly or slightly inclined from their lower cold end connected to the helium container towards their upper warm end connected to the outer shell.

The heat input into the helium container resulting from residual radiation, heat conduction through the neck pipes, and additional suspension members results in evaporation of the helium. Expensive helium must therefore be refilled at regular intervals. Since the evaporating helium cools the neck pipes and radiation shields coupled thereto, the heat input into the helium container is considerably reduced. The evaporation rate of liquid helium in cryostat arrangements for magnetic resonance apparatus without the active cooling described below is on the order of 0.1 l/h (liter per second) liquid or more.

To reduce costs associated with the refilling of expensive liquid helium, refrigerators are used in larger systems to provide active cooling. Such refrigerators are known e.g. from EP 0773450. They consist of a cold head mounted to a cryostat and its components, a compressor disposed at a separation from the cryostat, and pressure lines connecting the compressor to the cold head.

Cold heads for the applications mentioned herein usually have a mounting plate at room temperature, a cold finger mounted thereto and further components. During active cooling of cryostats, the mounting plate is almost always attached to the outer shell of the cryostat such that the cold finger projects either into a neck pipe or into a separate passage into the vacuum space. During operation, the end of the cold finger facing away from the mounting plate is cooled down to very low temperatures, e.g. 2–3 K.

The cold finger can consist of several pipes disposed parallel to one another which have different functions for generating an optimum cooling performance. Cold heads can have several stages. Thereby, a first stage disposed closer to the mounting plate is cooled to a first low temperature during operation, while the further stages are cooled to even lower temperatures.

The different stages of a cold head can be connected to the radiation shields and the helium container in a fashion which conducts heat well, to actively cool these components. Refrigerators for these applications can function e.g. according to the Gifford-McMahon principle or be designed as pulse tube coolers. Pulse tube coolers do not have any cold moving parts nor cold sealings which offers the advantage of long maintenance intervals and little mechanical vibration, which is advantageous for cryostats cooling magnets for magnetic resonance apparatus. In pulse tube coolers, the cold finger usually consists of two tubes per stage, disposed parallel to one another one of which is called the regeneration tube and the other the pulse tube.

Already in 1997, Thummes, Wang and Heiden have described in the document C. WANG, G. THUMMES, C. HEIDEN, CRYOGENICS 37,159 (1997) a refrigerator having a two-stage pulse tube cooler whose second stage produces a cooling performance of 170 mW at the boiling temperature of liquid helium of 4.2 K. This theoretically permits re-liquefying of evaporated helium gas at a temperature of 4.2 with a rate of 0.23 l/h of liquid.

In the document C. WANG, G. THUMMES, C. HEIDEN, CRYOGENICS 37,337 (1998) the same authors describe the use of this pulse tube cooler in a particular arrangement which permits cooling down of helium gas which was originally at room temperature and to liquefy same at a rate of 0.127 l/h of liquid. This is achieved in that the helium is guided through a thin tube which is wound about the regenerator pipes and is soldered thereto. Although the liquefying performance of the pulse tube cooler at 4.2 K is thereby reduced, the overall performance is considerably increased, since heat transfer is carried out at a higher than average temperature to thereby improve thermal efficiency.

Unfortunately, the cooling performance of these cold heads is too small to achieve either negligible or extremely small helium consumption in large magnet systems e.g. for magnetic resonance apparatus having high power input.

This is because in a cryostat arrangement that does not consume helium, the helium gas which normally results from evaporation and which flows off through the neck pipes to cool same is no longer available and the cold head must not only produce the power which the helium absorbs during evaporation, but also the power which the helium normally absorbs from the neck pipe through heating when rising therein. This heat power is many times the evaporation power which is required only for conversion of liquid into gas at the boiling temperature of 4.2 K.

In contrast thereto, it is the object of the present invention to improve a cryostat arrangement of the above described type with active refrigeration cooling through improvement of the thermal properties of the refrigerators. In particular, the invention should completely stop consumption of liquid helium.

SUMMARY OF THE INVENTION

This object is achieved in a surprisingly simple but effective fashion in that at least one pipe of the cold head installed into the neck pipe of the cryostat is surrounded by at least one separating body which divides the neck pipe into two partial volumes which are connected to one another both through a lower opening as well as an upper opening.

One partial volume directly borders the neck pipe and the other directly borders the above mentioned at least one pipe of the cold finger. The heat input through the neck pipe heats the helium in the partial volume bordering the neck pipe outside of the separating body while the helium in the partial volume within the separating body is cooled through the cooling power of the refrigerator.

This produces a temperature difference between the helium within the separating body and the helium between the separating body and neck pipe which again results in a different density of the two amounts of gas in the two partial volumes. The colder heavier amount of gas on the inside of the separating body flows downwardly and displaces, at the lower opening, the warmer and lighter gas between the neck pipe and the separating body thereby generating a convection cycle. The helium absorbs heat from the neck pipe during upward flow as in a conventional cryostat arrangement with helium consumption and, during flow, gives off heat to the cold head thereby pre-cooling the flowing-off helium.

This pre-cooling can be so efficient that further liquefying of the pre-cooled helium gas with high liquefying rates is possible, as mentioned e.g. in the publication C. WANG, G. THUMMES, C. HEIDEN, CRYOGENICS 37, 337 (1998).

In a preferred embodiment, the refrigerator can liquefy helium and condense the pre-cooled gas at the lower end of the separating body to completely stop consumption of liquid helium.

In a further preferred embodiment, the refrigerator is a pulse tube cooler. Pulse tube coolers are particularly suitable to pre-cool and liquefy originally warm gas due to their construction (see e.g. C. WANG, G. THUMMES, C. HEIDEN, CRYOGENICS 37, 337 (1998)). Moreover, pulse tube coolers are advantageous for cooling magnet systems in magnetic resonance apparatus due to their long maintenance intervals and low mechanical vibrations, which are considerably reduced with respect to all other refrigerator types.

In a preferred embodiment, the refrigerator has several stages. In this case, the first stage can be used e.g. for direct cooling of a radiation shield. It is moreover possible to produce particularly low temperatures with the last stage.

In a preferred embodiment, the separating body has poor heat conductivity to produce a large temperature difference between the gas outside and inside of the separating body. The drive of the helium cycle is thereby increased. The heat permeability $\lambda$ of the separating body should thereby be smaller than 10 kW $m^{-2}K^{-1}$, preferably on the order of 100 W $m^{-2}K^{-1}$ or less.

In a preferred embodiment, a material with good heat conducting properties connects one stage of the refrigerator to a radiation shield to permit direct active cooling of the radiation shield.

In an advantageous further development, the good heat-conducting connection between one stage of the cold head and a radiation shield is formed as a duct through the separating body. This permits direct cooling of a radiation shield by the stage of the refrigerator and also elongation of the separating body and thereby the spatial extent of the helium cycle from the lower end of the cold finger to its upper end, which can be favorable for the efficiency of the arrangement.

In a preferred embodiment, the lower opening of the separating body is at approximately the same height or below the lower end of the cold finger. In this fashion, the lower particularly cold regions of the cold finger are also utilized for cooling and liquefying the helium in the cycle.

An advantageous embodiment is characterized in that the lower end of the separating body is immersed in the liquid helium. Since the phase border surface within the separating body is too small to evaporate a sufficient amount of helium, condensation alone produces an underpressure in the inner partial volume of the separating body causing helium gas to flow out of the outer partial volume to the upper opening of the separating body. The helium cycle drive is thereby increased. Moreover, only an amount of gas flows which is equal to the amount of condensed gas thereby preventing excessively high convection.

In a preferred embodiment, the upper opening of the separating body is located below the first stage of the cold head thereby cooling only the region of the neck pipe in the helium cycle via the upwardly flowing helium. This region is directly connected to the helium container and the cooling thereof is particularly important for achieving negligible helium consumption. The construction of the separating body can also be simplified in this case.

In an alternatively preferred embodiment, the upper opening of the separating body is above the first stage of the refrigerator. In this fashion, all stages of the cold head are incorporated into the helium cycle. The upper opening in the separating body can also be designed as pipe-shaped connection between the two partial volumes and be guided out of the neck pipe.

Finally, in a further preferred embodiment, the separating body consists of an evacuated container completely surrounding at least one pipe of the cold finger, and at least one cooling pipe which is installed therein and is open at its ends and which is guided at an upper and a lower position in a vacuum-tight fashion through the evacuated container and, within the evacuated container, is in heat-conducting contact with at least one pipe of the cold head surrounded by the evacuated container. In this embodiment of the separating body, the inner space of the at least one cooling pipe forms one partial volume and the region surrounding the evacuated container forms the second partial volume and the ends of the at least one cooling pipe form the above mentioned openings in the separating body. In this fashion, it is in principle possible to optimize the efficiency of pre-cooling and subsequent liquefying of the flowing-off helium gas in the cooling pipe through design of the cooling pipe and via the detailed fashion by which the cooling pipe is guided along the different pipes of the cold finger.

Further advantages can be extracted from the drawing and the description. The features mentioned above and below can be utilized in accordance with the invention either individually or collectively in any arbitrary combination. The embodiments shown and described are not to be understood as exhaustive enumeration but rather have exemplary character for describing the invention.

The invention is shown in the drawing and further explained by means of embodiments.

DESCRIPTION OF THE PREFERRED EMBODIMENT

Figure 1:
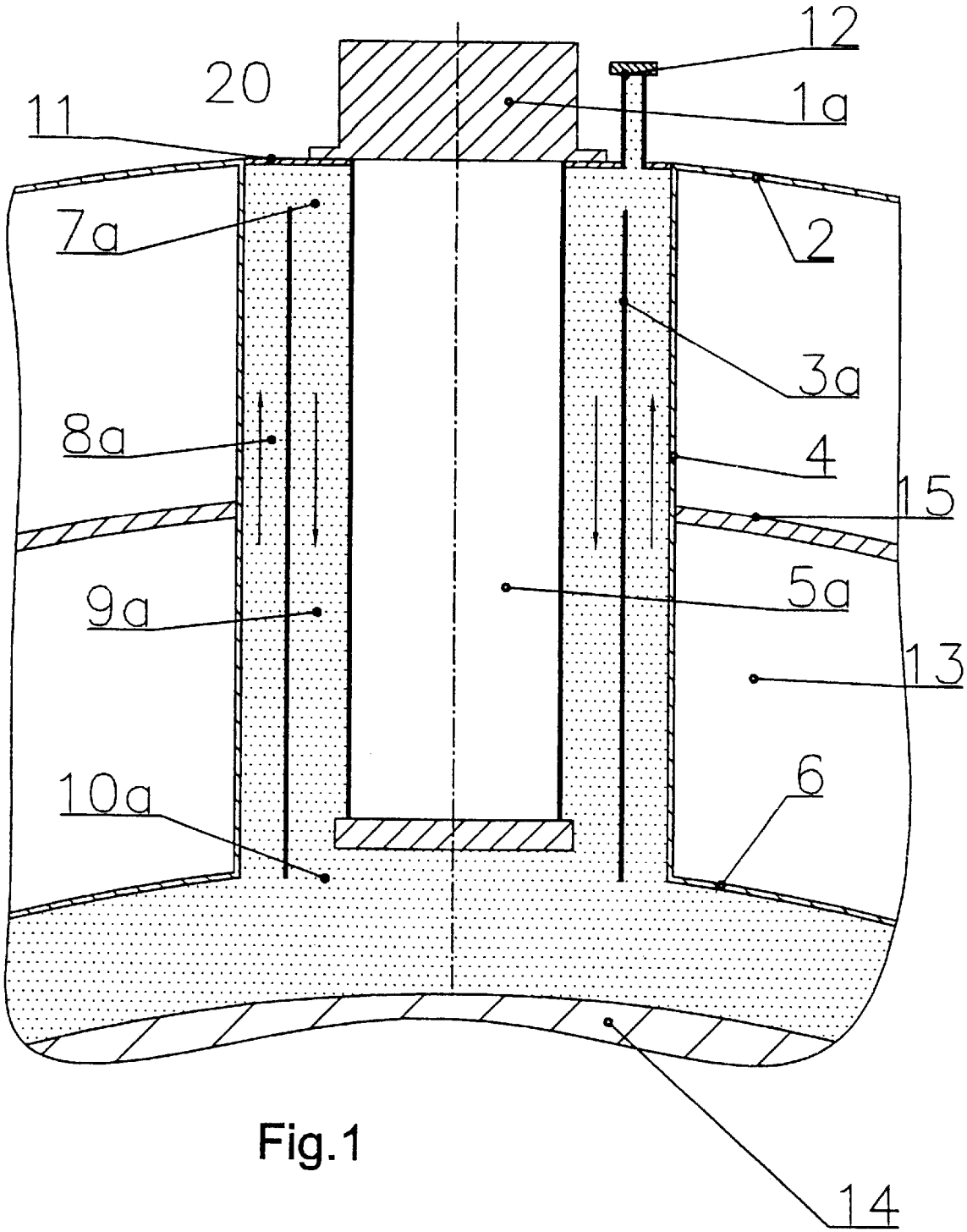
FIG. 1 shows a section through the neck pipe section of an inventive cryostat arrangement.

FIG. 1 is a section through the neck pipe region of a cryostat arrangement and shows the principal structural elements of a conventional cryostat arrangement as well as the further inventive developments.

The outer shell 2, the neck pipe 4 and the helium container 6 define the vacuum space 13. The vacuum space 13 separates the helium container from the external space 20 and prevents heat input into the helium container through convection or heat conduction of gases. A radiation shield 15 is installed into the vacuum space 13 which completely surrounds the helium container 6. The radiation shield 15 is thermally connected to the neck pipe 4. In this fashion, the heat delivered to the radiation shield, mainly through heat radiation from the outer shell 2 can be given off to the helium gas in the neck pipe. The neck pipe 4 forms the connection between the helium container 6 and the outer shell 2.

The schematically drawn stopper 12 in the mounting plate 11 permits filling of liquid helium and allows for electrical connections to the superconducting magnet 14 installed in the helium container, e.g. for charging the superconducting magnet. The helium gas produced during a quench must be able to flow through the neck pipe 4 and the stopper 12 into the external space. Furthermore, a connection from the helium enclosed in the helium container 6 and neck pipe 4 to a supply container or a collecting container for helium gas can pass through the stopper 12 by means of which helium gas can be guided back into the helium container when the liquefying performance of the inventive cryostat arrangement is sufficient.

The cold head 1*a* is mounted to the mounting plate 11 and projects, with its cold finger 5*a*, into the neck pipe 4. The cold head l*a* is connected to the outer shell 2 of the cryostat via the mounting plate 11.

The inventive improvement of such a cryostat arrangement is effected by the separating body 3*a* which divides the free neck pipe volume into the partial volumes 8*a* and 9*a*. The separating body has a lower opening 10*a* and an upper opening 7*a* which basically permit generation of a helium gas cycle within the neck pipe.

Heat is supplied to the helium gas in the partial volume 8*a* through contact with the surface of the neck pipe 4 while heat is withdrawn from the helium gas in the partial volume 9*a* through contact with the surface of parts of the cold finger 5*a*. Consequently, the helium gas in the partial volume 8*a* has, on average, a higher temperature than the helium gas in the partial volume 9*a*. Due to the density difference associated with these temperature differences, helium flows upwards in the partial volume 8*a* and downwards in the partial volume 9*a*. The upward flow of the helium gas, with an original temperature of approximately 4.2 K, cools the neck pipe 4 and the radiation shield which considerably reduces the heat load of the helium container 6 due to heat conduction in the neck pipe 4 and also due to heat radiation from the radiation shield 15, pre-cooled in this fashion.

Heating of the helium gas, which is inversely associated with cooling of the neck pipe 4 and the radiation shield 15, is required for maintaining the convection stream described herein. The helium gas flowing downwardly in the partial volume 9*a* can be pre-cooled with great efficiency by the cold finger 5*a* or by parts of the cold finger (see C. WANG, G. THUMMES, C. HEIDEN, CRYOGENICS 37, 337 (1998)) such that liquefaction at the lower end of the cold finger is even possible at considerable liquefying rates.

The helium cycle in the neck pipe and the flow directions thereof are indicated herein with arrows, as in the other illustrations.

Figure 2:
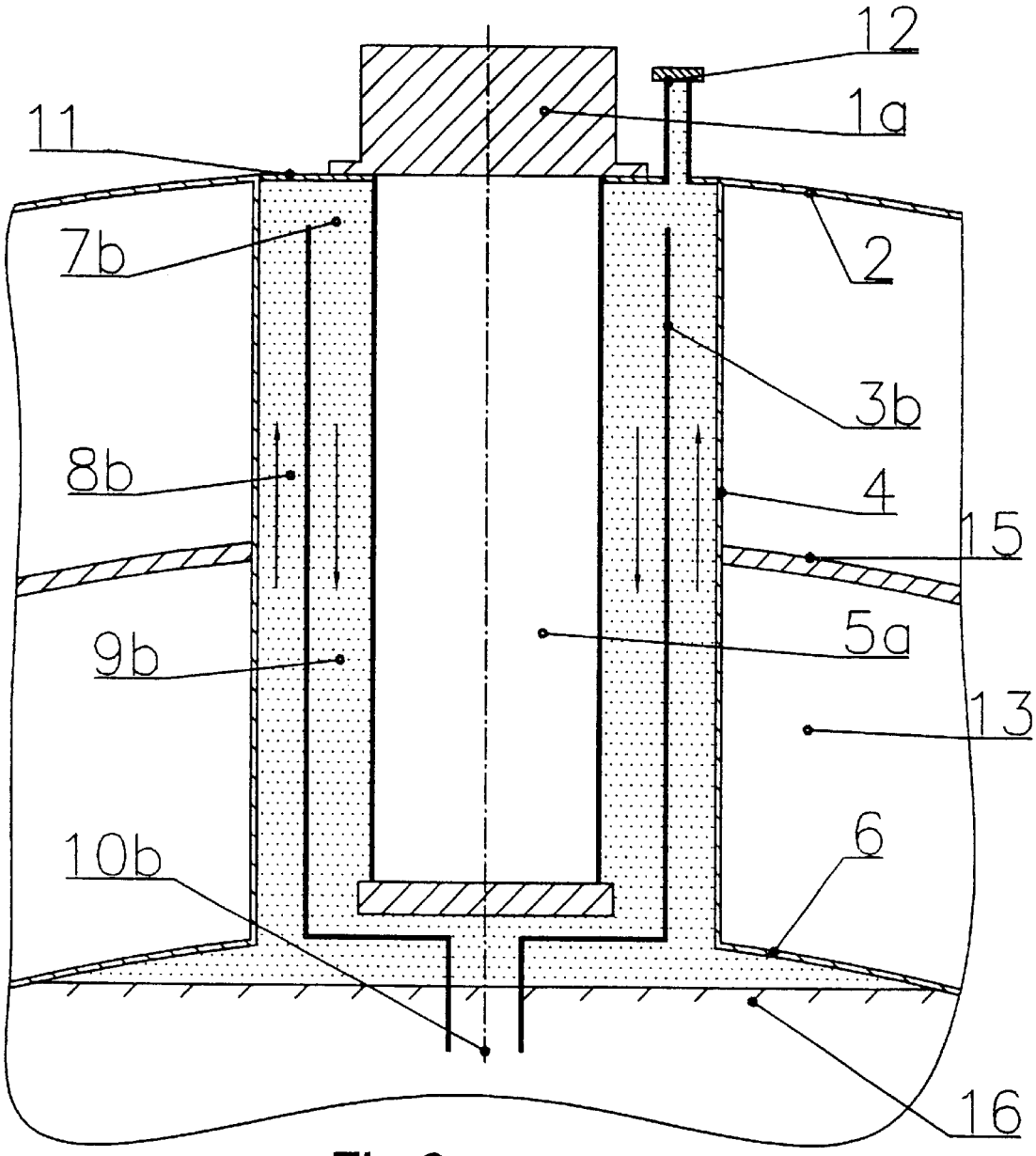
FIG. 2 shows a section through a special embodiment of the neck pipe region of an inventive cryostat arrangement.

In contrast to FIG. 1, the separating body 3*b* of FIG. 2 is designed and the operating state of the cryostat arrangement is selected such that the lower opening 10*b* of the separating body 3*b* is located completely below the surface of the liquid helium 16 bath. In this arrangement, the desired helium cycle is even possible without the convection mechanism. Herein, the liquid helium inside the partial volume 9*b* is in an undercooled state at correspondingly reduced vapor pressure due to undercooled helium dripping from the cold finger 5*a*. The downward flow in the inner partial volume 9*b* is herein produced merely through condensation of helium gas at the lower end of the cold finger 5*a* and on the surface of the helium bath within the partial volume 9*b*.

Figure 3:
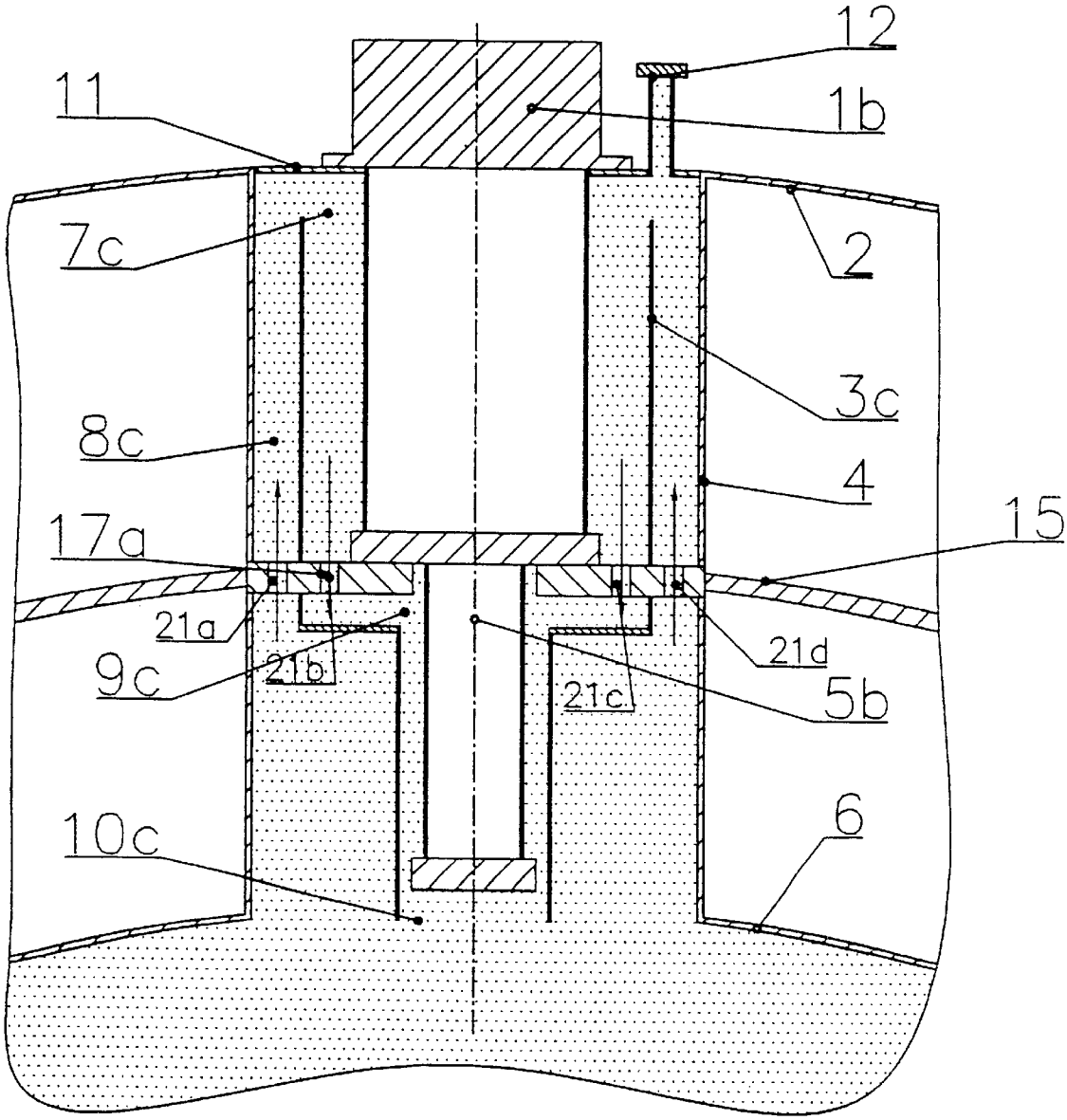
FIG. 3 shows a section through a further special embodiment of the neck pipe region of an inventive cryostat arrangement.

In contrast to FIG. 1, FIG. 3 shows the cold head 1*b* of the refrigerator designed with two stages. The first stage is connected to the radiation shield 15 via a connection 17*a* having good heat-conducting properties. The openings 21*a, b, c, d* in the heat-conducting connection enable generation of the desired helium cycle. The heat-conducting connection 17*a* permits very good cooling of the radiation shield 15. A disadvantage of this arrangement may be that vibrations of the cold head 1*b* are directly transmitted onto the radiation shield, which can impair the quality of magnetic resonance apparatus. This principal disadvantage is completely eliminated in the arrangement shown in FIG. 1.

Figure 4:
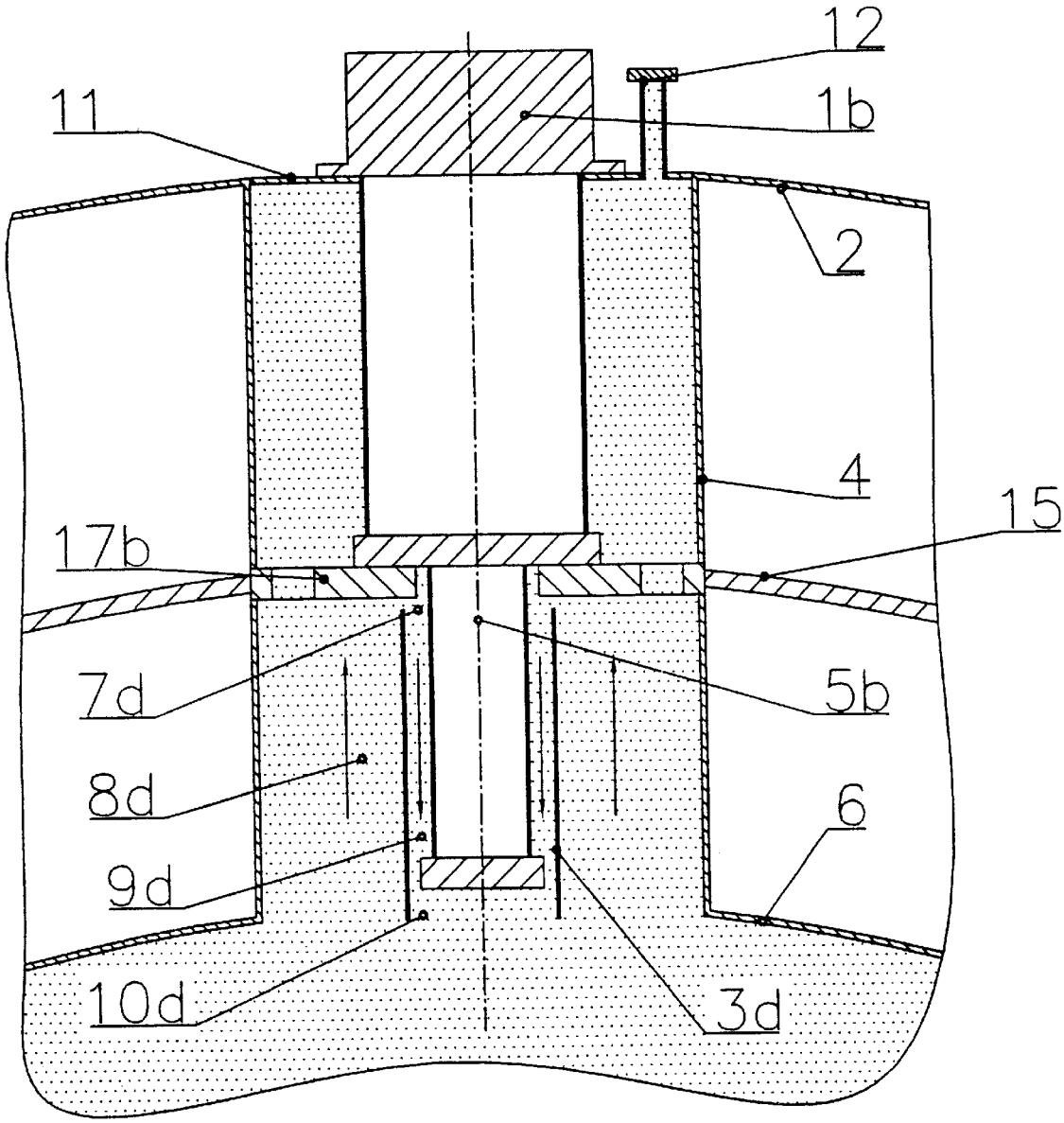
FIG. 4 shows a section through a further special embodiment of the neck pipe region of an inventive cryostat arrangement.

In FIG. 4, the first stage of the cold head 1*b* is connected to the radiation shield 15 through a connection 17*b*, also having good heat-conducting properties. In contrast to FIG. 3, the openings 7*d* and 10*d* of the separating body 3*d* are located completely below this connection 17*b* (in accordance with one of the claims) which considerably facilitates the construction of the separating body 3*d*. On the other hand, this type of arrangement would be sufficient, in many cases, to completely stop consumption of liquid helium since heat loading of the helium container 6 is also largely prevented through heat conduction in the neck pipe.

Figure 5:
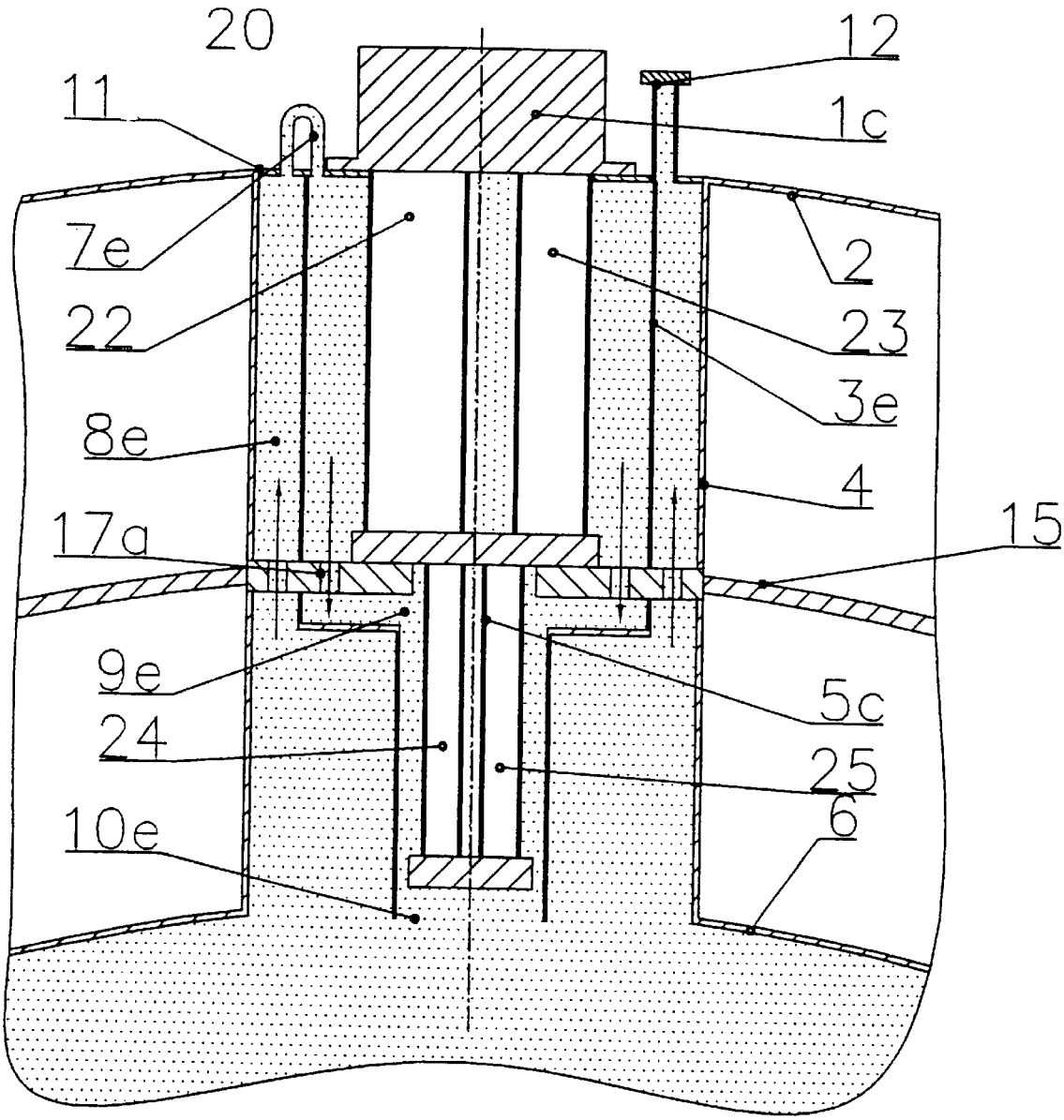
FIG. 5 shows a section through a further special embodiment of the neck pipe region of an inventive cryostat arrangement.

In FIG. 5, the upper opening 7*e* of the separating body 3*e* is designed as pipe-shaped connection between the two partial volumes 8*e* and 9*e*. This pipe-shaped connection is located in the external space 20 and is thus freely accessible. By means of adjustable valves installed in the pipe-shaped connection or active circulating pumps, it is possible to influence and optimize the flow strength in the helium cycle of this arrangement. Moreover, the cold finger 5*c* of the two-stage cold head 1*c* consists of several pipes 22, 23, 24, 25. This construction of the cold finger is typical for pulse tube coolers. Gifford-McMahon coolers can be designed in the same fashion. The separating body surrounds the entire cold finger.

Figure 6:
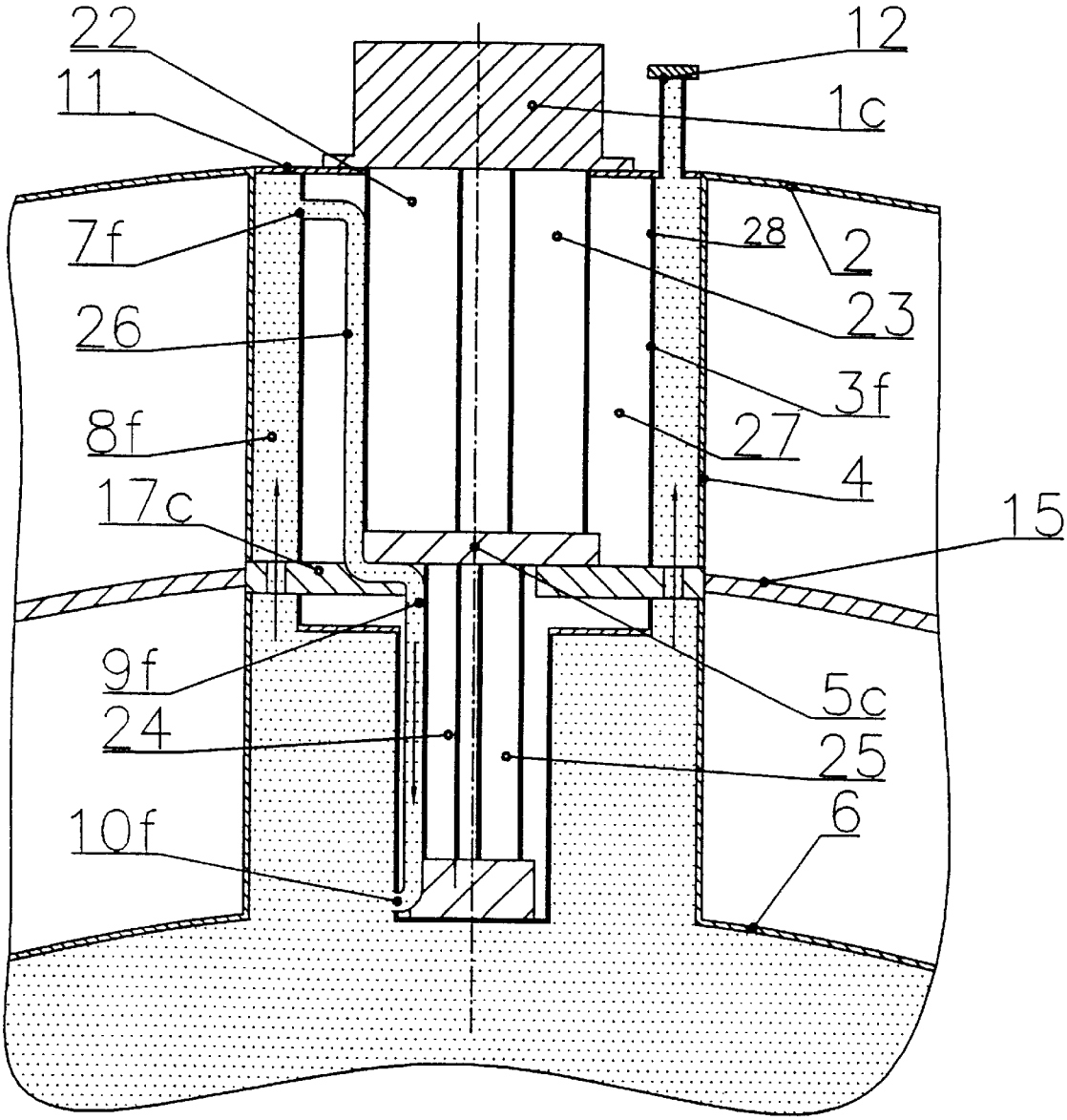
FIG. 6 shows a section through a further special embodiment of the neck pipe region of an inventive cryostat arrangement.

FIG. 6 shows a special shape of the separating body 3*f*. It is formed of an outer sleeve 28 and a cooling pipe 26 which together surround a vacuum space 27. The cooling pipe 26 is connected, e.g. soldered, to the pipes 22 and 24 of the cold finger 5*c* of the cold head, nearly along their entire length and in a good heat-conducting fashion. The cooling pipe may be an integral part of the cold head. The partial volume of the neck pipe 9*f* bordering the cold finger is surrounded by the cooling pipe 26 while the partial volume 8*f* bordering the neck pipe is located outside of the outer sleeve 28 of the separating body 3*f*. To improve the heat exchange between the helium in the cooling pipe and the cold finger and to simultaneously prolong the heat bridge along the cold finger, represented by the cooling pipe, it may be advisable to dispose the cooling pipe 26 in windings about the respective pipes of the cold finger.

We claim:

1. A cryostat means for storing liquid helium, comprising:

an outer shell;

a helium container installed within said outer shell;

a neck pipe disposed between and communicating with said outer shell and said helium container, said neck pipe having an upper warm end connected to said outer shell and a lower cold end connected to said helium container, wherein said outer shell, said helium container, and said neck pipe define an evacuated space;

a radiation shield disposed within said evacuated space, said radiation shield surrounding said helium container and connected at a coupling to said neck pipe in a heat-conducting manner;

a refrigerator having a cold finger with at least one pipe and projecting into said neck pipe; and at least one separating body disposed to surround said at least one pipe, said separating body dividing an inside region of said neck pipe into a first and a second partial volume, wherein said first and said second partial volumes are in fluid communication with another at an upper location and at a lower location.

2. The cryostat means of claim 1, wherein said refrigerator comprises means to liquefy helium.

3. The cryostat means of claim 1, wherein said refrigerator comprises a pulse tube cooler.

4. The cryostat means of claim 1, wherein said refrigerator comprises several stages.

5. The cryostat means of claim 1, wherein said separating body has a heat permeability $\lambda<10$ kW $m^{-2}$ $K^{-1}$.

6. The cryostat means of claim 5, wherein said $\lambda \leqq 100$W $m^{-2}$ $K^{-1}$.

7. The cryostat means of claim 1, further comprising a connection having good heat-conducting properties disposed, with heat conducting connection, between said coupling of said radiation shield to said neck pipe and a stage of said refrigerator.

8. The cryostat means of claim 7, wherein said connection having good heat-conducting properties has a duct through said separating body.

9. The cryostat means of claim 1, wherein said lower location of said separating body is disposed at approximately a same height as a lower end of said cold finger of said refrigerator.

10. The cryostat means of claim 1, wherein said lower location of said separating body is disposed below a lower end of said cold finger.

11. The cryostat means of claim 1, wherein said lower location of at least one said separating body is immersed into a bath of liquid helium.

12. The cryostat means of claim 1, wherein said upper location of said separating body is disposed below said coupling of said radiation shield to said neck pipe.

13. The cryostat means of claim 1, wherein said separating body comprises at least one evacuated container completely surrounding said at least one pipe of said cold finger and a cooling pipe having an upper and a lower opening at ends thereof, said cooling pipe guided at an upper and a lower position through said evacuated container in a vacuum-tight fashion and disposed within said evacuated container in heat-conducting contact with said at least one pipe.

* * * * *